US008472649B2

(12) United States Patent
Yang

(10) Patent No.: US 8,472,649 B2
(45) Date of Patent: Jun. 25, 2013

(54) PUSH-PULL TYPE SPEAKER DEVICE AND METHOD OF MANUFACTURING THE SAME

(75) Inventor: Dong Il Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 376 days.

(21) Appl. No.: 12/558,997

(22) Filed: Sep. 14, 2009

(65) Prior Publication Data

US 2010/0080406 A1 Apr. 1, 2010

(30) Foreign Application Priority Data

Sep. 29, 2008 (KR) ..... 10-2008-0095355

(51) Int. Cl.
*H04R 7/00* (2006.01)
*H04R 31/00* (2006.01)

(52) U.S. Cl.
USPC ..... 381/186; 381/182

(58) Field of Classification Search
USPC ..... 381/182, 77, 89, 186, 199, 195, 431, 381/420
See application file for complete search history.

(56) References Cited

U.S. PATENT DOCUMENTS

| | | | | |
|---|---|---|---|---|
| 5,450,495 | A * | 9/1995 | Goldfarb | 381/89 |
| 5,901,235 | A * | 5/1999 | Thigpen et al. | 381/431 |
| 2005/0175213 | A1* | 8/2005 | Stiles | 381/414 |
| 2005/0185808 | A1* | 8/2005 | Hsu Huang | 381/182 |
| 2005/0244016 | A1* | 11/2005 | Norris et al. | 381/77 |
| 2008/0075319 | A1* | 3/2008 | Kantor et al. | 381/420 |

* cited by examiner

*Primary Examiner* — Duc Nguyen
*Assistant Examiner* — Phan Le
(74) *Attorney, Agent, or Firm* — Jefferson IP Law, LLP

(57) ABSTRACT

A push-pull type speaker device and a method of manufacturing the same are provided. The speaker device includes a frame, a permanent magnet installed within the frame using a fixing device, a first diaphragm and a second diaphragm installed in opposite end portions of the frame, a pair of electromagnets, respectively corresponding to the first and second diaphragm, each installed at a distance from the permanent magnet, and a power source driver for supplying current to the pair of electromagnets, wherein a winding direction of each electromagnet is formed such that, when current is provided from the power source driver to each of the electromagnets, the pair of electromagnets have an opposite magnetic flux direction.

18 Claims, 5 Drawing Sheets

PUSH-PULL TYPE SPEAKER DEVICE AND METHOD OF MANUFACTURING THE SAME

PRIORITY

This application claims the benefit under 35 U.S.C. §119 (a) of a Korean patent application filed in the Korean Intellectual Property Office on Sep. 29, 2008 and assigned Serial No. 10-2008-0095355, the entire disclosure of which is hereby incorporated by reference.

BACKGROUND OF THE INVENTION

1. Field of the Invention

The present invention relates to a push-pull type speaker device and a method of manufacturing the same. More particularly, the present invention relates to a push-pull type speaker device and a method of manufacturing the same that can convert magnetic fluxes to a sound signal by disposing an electromagnet at both a north pole and a south pole of a permanent magnet used for the speaker device and enabling a magnetic flux coupled to the north pole and a magnetic flux coupled to the south pole to drive a push-pull type diaphragm.

2. Description of the Related Art

In general, a speaker is a device for receiving an electrical signal and outputting the electrical signal as an audible sound. Specifically, a speaker outputs the audible sound by converting electrical energy from the received electrical signal into mechanical energy using a coil electromagnet. More specifically, the electrical energy is converted into mechanical energy by the coil electromagnet according to Fleming's left-hand rule, in which, when a current flows through a conductor existing within a magnetic field, the conductor receives a force.

When an electrical current signal having several frequencies is applied to the electromagnet, the electromagnet generates a sound pressure at a level that can be detected by the human ear. The electromagnet generates the sound pressure by generating mechanical energy according to current intensity and frequency intensity and enabling a diaphragm attached to the electromagnet to vibrate.

Specifically, a magnetic circuit of the speaker is designed so that a magnetic flux thereof is formed between the electromagnet and a permanent magnet within a frame. Furthermore, the electromagnet is coupled to the diaphragm to generate an electromotive force, driven by an input signal, to vibrate the diaphragm, thereby generating a sound pressure.

The sound pressure generated in the speaker changes according to a position, size, and resonance structure of the speaker and a magnetic flux generating ability between the permanent magnet and the electromagnet. Therefore, when the magnetic flux generated per unit area of the permanent magnet is maximized, an electric signal can be most efficiently converted into a sound signal. However, in a conventional speaker, because an electromagnet is positioned only at one side of a permanent magnet, a limitation in magnetic flux generating ability of an entire magnetic flux of both poles and a speaker diaphragm driving magnetic flux exists.

In order to increase the sound volume of the conventional speaker, a method of securing a resonance space by increasing a diameter and height of the speaker is used. However, this increased bulk of the speaker has lead to a demand for reducing a size while improving a performance of the speaker. Accordingly, there is a need for a speaker device that can convert both a magnetic flux coupled to a north pole and a magnetic flux coupled to a south pole into a sound signal using the north pole and the south pole of a permanent magnet.

SUMMARY OF THE INVENTION

An aspect of the present invention is to address at least the above-mentioned problems and/or disadvantages and to provide at least the advantages described below. Accordingly, an aspect of the present invention is to provide a speaker device and a method of manufacturing the same that can convert both a magnetic flux coupled to a north pole and a magnetic flux coupled to a south pole to a sound signal using the north pole and the south pole of a permanent magnet.

Another aspect of the present invention is to provide a speaker device and a method of manufacturing the same having a reduced size and an increased magnetic flux generating ability with only a single permanent magnet by using both a north pole and a south pole of the permanent magnet.

In accordance with an aspect of the present invention, a speaker device is provided. The device includes a frame, a permanent magnet installed within the frame using a fixing device, a first diaphragm and a second diaphragm installed in both end portions of the frame, a pair of electromagnets, respectively corresponding to the first and second diaphragm, each installed at a distance from the permanent magnet, and a power source driver for supplying a current to the pair of electromagnets, wherein a winding direction of each electromagnet is formed such that, when current is provided from the power source driver to each of the electromagnets, the pair of electromagnets have an opposite magnetic flux direction.

In an exemplary implementation, the winding direction of each electromagnet is in an opposite direction if the power source driver supplies a current of the same phase to the pair of electromagnets.

In an exemplary implementation, the winding direction of each electromagnet is in an identical direction if the power source driver supplies a current to the pair of electromagnets in a differential pair method.

In an exemplary implementation, the power source driver adjusts a phase difference between a sound signal output by driving the first diaphragm and a sound signal output by driving the second diaphragm.

In an exemplary implementation, each electromagnet is wound in a cylindrical shape to be attached to the diaphragm.

In an exemplary implementation, each electromagnet is printed in an eddy shape in the diaphragm to be formed integrally with the diaphragm.

In an exemplary implementation, the fixing device includes a plurality of grooves formed at the periphery of the permanent magnet, and a plurality of protrusions formed within the frame and inserted into the plurality of grooves.

In accordance with another aspect of the present invention, a method of manufacturing a speaker device is provided. The method includes installing a permanent magnet within a frame using a fixing device, disposing a first diaphragm and a second diaphragm at a distance from the permanent magnet and attaching the first diaphragm and the second diaphragm to opposite end portions of the frame, installing a pair of electromagnets, respectively corresponding to the first and second diaphragm, for receiving current from a power source driver, wherein the forming of the pair of electromagnets for receiving current from the power source driver comprises forming a winding direction of each electromagnet such that, when current is provided from the power source driver to each of the electromagnets, the pair of electromagnets have an opposite magnetic flux direction.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
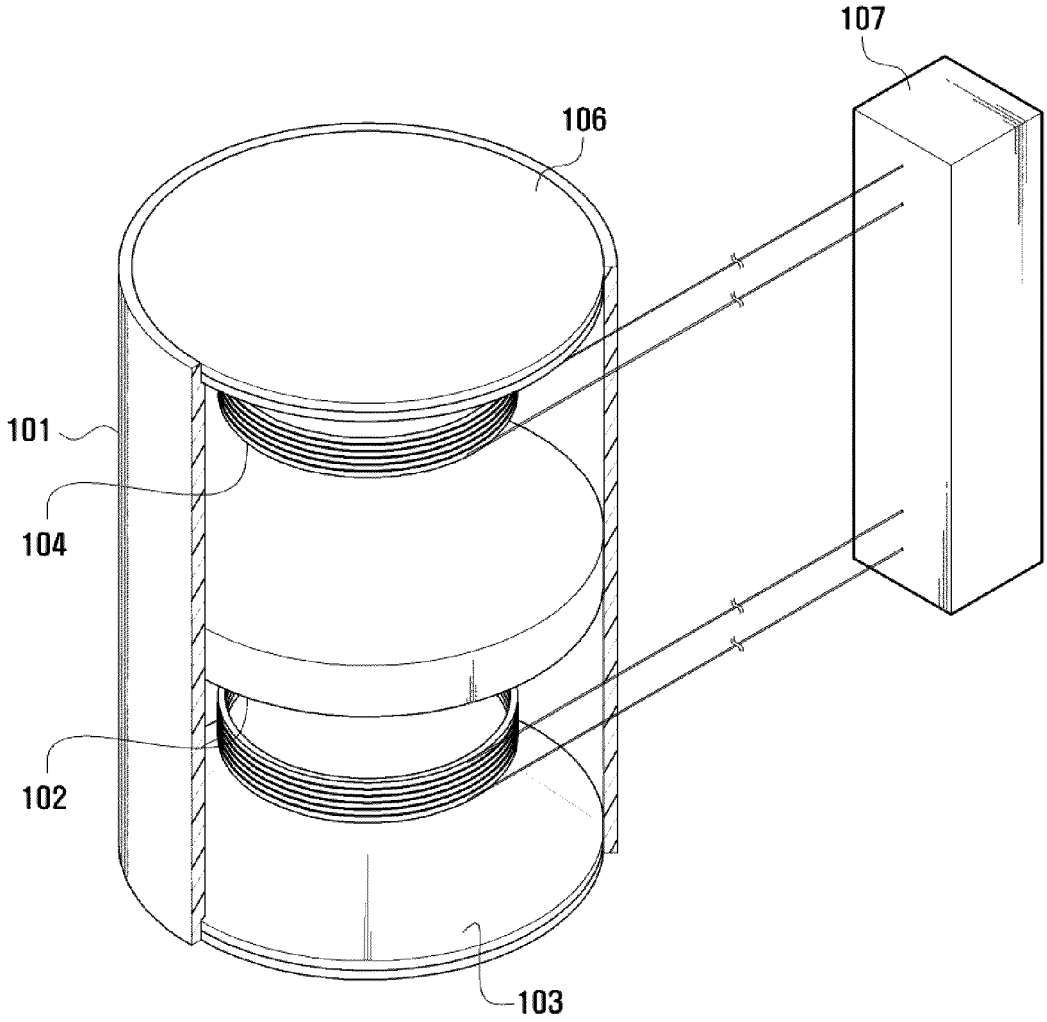
FIG. 1 is a cut-away perspective view illustrating a configuration of a push-pull type speaker device according to an exemplary embodiment of the present invention.

FIG. 1 is a cut-away perspective view illustrating a configuration of a push-pull type speaker device according to an exemplary embodiment of the present invention.

Referring to FIG. 1, the push-pull type speaker device includes a frame 101, a permanent magnet 102, a diaphragm 103, an electromagnet 104, a fixing device 105 (not shown in FIG. 1), a cover plate 106, and a power source driver 107.

The permanent magnet 102, diaphragm 103, and electromagnet 104 are positioned in an internal space of the frame 101. In order to prevent magnetic loss of the permanent magnet 102, the frame 101 is preferably made of a non-magnetic material. Furthermore, the frame may be made of a non-magnetic material by a process such as injection molding. In the illustrated exemplary embodiment, the frame 101 is formed in a cylindrical shape. However, the shape of the frame 101 is not limited thereto and the frame 101 may be formed in various shapes, such as a polygonal pillar of a triangular shape, a quadrangular shape, a pentagonal shape, an oval pillar, and the like, in addition to the cylindrical shape.

The permanent magnet 102 is installed in an intermediate portion in an axial direction of the frame 101 by the fixing device 105 and is formed in the same shape as that of the frame 101. For example, if the frame 101 is formed having a circular shape, the permanent magnet 102 is also formed having a circular shape. The permanent magnet 102 may be formed of a rare earth magnet, preferably a neodymium (Nd) magnet, having a very strong magnetic energy and used for a high-tech product of a small size and light weight. A speaker device using an Nd magnet is typically integrally mounted in a small sized computer, such as a palmtop computer and laptop computer, or an LCD monitor.

The electromagnet 104 receives a current from the power source driver 107. As will be explained in more detail below, the electromagnet 104 is comprised of two electromagnets 104*a* and 104*b* which both receive a current from the power source driver 107.

The cover plate 106 is installed in an outer end portion of the frame 101 and covers an opening of the frame 101. Of course, the cover plate 106 is acoustically transparent in that sound generated by the diaphragm 103 is not substantially disrupted by the cover plate 106.

Figure 2:
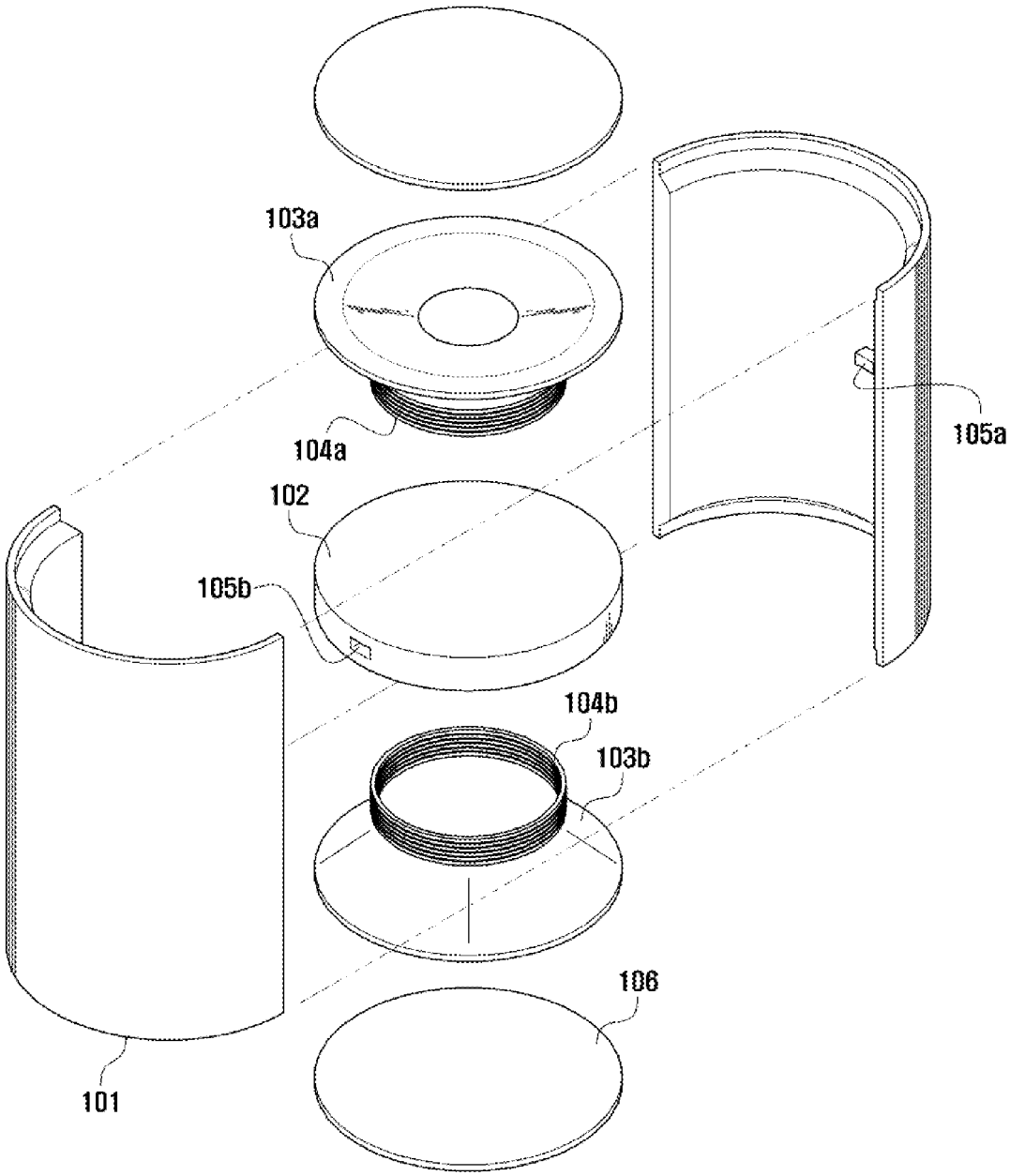
FIG. 2 is an exploded perspective view of the push-pull type speaker device of FIG. 1 according to an exemplary embodiment of the present invention.

FIG. 2 is an exploded perspective view of the push-pull type speaker device of FIG. 1 according to an exemplary embodiment of the present invention.

Referring to FIG. 2, the diaphragm 103 includes an upper diaphragm 103*a* disposed in an upper part of the frame 101 and a lower diaphragm 103*b* disposed in a lower part of the frame 101. The electromagnet 104*a* and the electromagnet 104*b* are respectively disposed at a surface of the upper diaphragm 103*a* and a surface of the lower diaphragm 103*b*. Furthermore, as will be discussed in more detail with reference to FIG. 4, the electromagnets 104*a* and 104*b* may be wound in a cylindrical shape in the axial direction of the frame 101 in a surface of the diaphragm 103.

The fixing device 105 includes a plurality of protrusions 105*a* formed at positions within the frame 101 and a plurality of grooves 105*b* formed in the periphery of the permanent magnet 102. The permanent magnet 102 is fixed to the frame 101 by inserting the protrusions 105*a* of the frame 101 into corresponding grooves 105*b* of the permanent magnet 102. That is, a protrusion 105*a* formed in a semi-cylindrical portion of the frame 101 is inserted into a corresponding groove 105*b* of the permanent magnet 102, then the remaining semi-cylindrical portion of the frame 101 is arranged so that the protrusion 105*a* formed thereon is inserted into the corresponding groove 105*b* of the permanent magnet 102.

In the illustrated exemplary embodiment, a fixing mechanism of the frame 101 and the permanent magnet 102 is described in the form of a coupling structure of the plurality of protrusions 105*a* and grooves 105*b*. However, the fixing mechanism is not limited thereto. For example, a conventional fixing mechanism can be used to fix constituent elements to each other, such as forming a '⊏' shaped part within the frame 101 and inserting the permanent magnet 102 into a groove of the part, or bonding the frame 101 and the permanent magnet 102 together.

Figure 3:
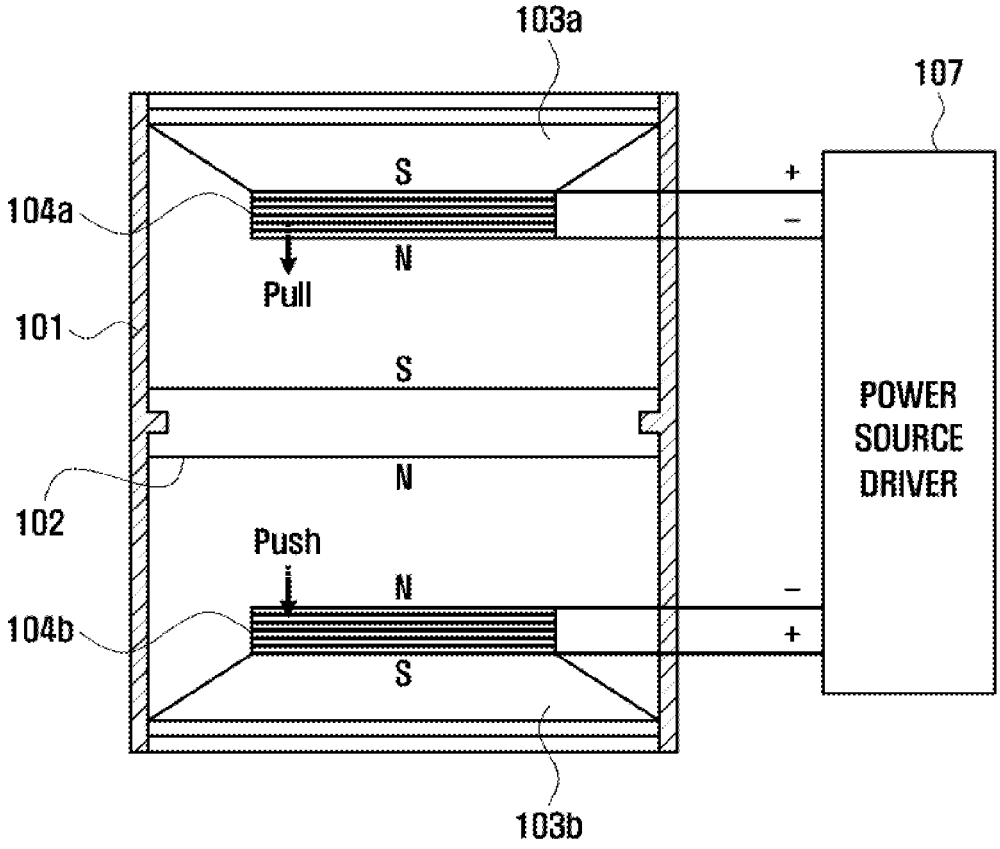
FIG. 3 is a diagram illustrating a push-pull type speaker device according to an exemplary embodiment of the present invention.

FIG. 3 is a diagram illustrating a push-pull type speaker device according to an exemplary embodiment of the present invention.

Referring to FIG. 3, the electromagnet 104*b* is positioned at a north pole side of the permanent magnet 102. A winding direction of the electromagnet 104*b* is formed such that, when a current that is supplied from the power source driver 107 flows through the electromagnet 104*b*, a north pole of the electromagnet 104*b* is formed at a side thereof adjacent to the permanent magnet 102 and a south pole of the electromagnet 104*b* is formed at a side thereof furthest from the permanent magnet 102. The electromagnet 104*a* is positioned at a south pole side of the permanent magnet 102. A winding direction of the electromagnet 104*a* is formed such that, when a current that is supplied from the power source driver 107 flows through the electromagnet 104*a*, a north pole of the electromagnet 104*a* is formed at a side thereof adjacent to the permanent magnet 102 and a south pole of the electromagnet 104*a* is formed at a side thereof furthest from the permanent magnet 102. Therefore, when current is supplied from the power source driver 107 to both the electromagnet 104*a* and the electromagnet 104*b*, a pushing or repelling force operates between the north pole side of the permanent magnet 102 and the north pole side of the electromagnet 104*b*. At the same time, a pulling or attracting force operates between the south pole side of the permanent magnet 102 and the north pole side of the electromagnet 104*a*. Accordingly, when the power source driver 107 supplies current to the electromagnet 104*a* and the electromagnet 104*b* such that the upper diaphragm 103*a* and the lower diaphragm 103*b* are driven, air is pushed out in only one of an upper direction and a lower direction.

More specifically, when the power source driver 107 supplies a current of the same phase, the electromagnets 104*a* and 104*b* are formed to have an opposite winding direction, and when a current is supplied in a differential pair method, i.e. when a current is supplied in an opposite phase, the electromagnets 104*a* and 104*b* are formed to have an identical winding direction. Therefore, as the upper diaphragm 103*a* and the lower diaphragm 103*b* always vibrate in one direction and an upside sound signal and a downside sound signal perform reinforcement interference, the sound volume is increased by about two times.

In this case, the power source driver 107 adjusts a phase difference between a sound signal output by driving the upper diaphragm 103*a* and a sound signal output by driving the lower diaphragm 103*b*. That is, in order to adjust a phase difference (i.e., time delay) between a sound signal output from the upper diaphragm 103*a* and a sound signal output from the lower diaphragm 103*b*, the power source driver 107 determines a phase difference between sound signals output by a distance between the upper diaphragm 103*a* and the lower diaphragm 103*b* by analyzing a waveform of a sound signal in relation to a frequency of an electric signal supplied to the electromagnets 104*a* and 104*b* and adjusts a phase difference between sound signals by supplying an electric signal delayed by the phase difference to the electromagnets 104*a* and 104*b*. In this way, by adjusting a phase difference between sound signals with the power source driver 107, an optimized sound source reproduction effect can be obtained.

A method of manufacturing a push-pull type speaker device according to an exemplary embodiment of the present invention is described hereinafter.

The permanent magnet 102 is installed within the frame 101 using the protrusions 105*a* and groves 105*b* or other fixing device. FIG. 2 illustrates a configuration where the frame 101 is divided into 2 semi-cylindrical portions, wherein a plurality of protrusions 105*a* are formed within the frame 101. After the protrusion 105*a*, formed within one of the semi-cylindrical portions of the frame 101, is inserted into one of a plurality of grooves 105*b*, formed in a periphery of the permanent magnet 102, the protrusion 105*a* formed within the remaining semi-cylindrical portion of the frame 101 is inserted into another of the grooves 105*b*. In the present exemplary embodiment, a south pole of the permanent magnet 102 is disposed at an upper part thereof and a north pole of the permanent magnet 102 is disposed at a lower part thereof.

The electromagnets 104*a* and 104*b* are formed in the upper diaphragm 103*a* and the lower diaphragm 103*b*, respectively. The electromagnet 104*a* is wound in a cylindrical shape in the axial direction of the frame 101 and is attached to a lower surface of the upper diaphragm 103*a*, and the electromagnet 104*b* is wound in a cylindrical shape in the axial direction of the frame 101 and is attached to an upper surface of the lower diaphragm 103*b*.

In this case, the electromagnet 104*b* is positioned at a north pole side of the permanent magnet 102. A winding direction of the electromagnet 104*b* is formed such that, when a current flows, a north pole of the electromagnet 104*b* is formed at a side thereof adjacent to the permanent magnet 102 and a south pole of the electromagnet 104*b* is formed at a side thereof furthest from the permanent magnet 102. The electromagnet 104*a* is positioned at a south pole side of the permanent magnet 102. A winding direction of the electromagnet 104*a* is formed such that, when a current flows, a north pole of the electromagnet 104*a* is formed at a side thereof adjacent to the permanent magnet 102 and a south pole of the electromagnet 104*a* is formed at a side thereof furthest from the permanent magnet 102. Therefore, a pushing force operates at the north pole side of the permanent magnet 102 and a pulling force operates at the south pole side of the permanent magnet 102 so that, when the upper diaphragm 103*a* and the lower diaphragm 103*b* are driven, air is pushed out in only one of an upper direction and a lower direction.

More specifically, when the power source driver 107 supplies a current of the same phase, the electromagnets 104*a* and 104*b* are formed to have an opposite winding direction, and when a current is supplied in a differential pair method, i.e. when a current is supplied in an opposite phase, the electromagnets 104*a* and 104*b* are formed to have an identical winding direction.

The upper diaphragm 103*a* and the lower diaphragm 103*b* are respectively attached to an upper part and a lower part of the frame 101 at a distance from an upper and lower surface of the permanent magnet 102.

By connecting an input terminal and output terminal of each of the electromagnets 104*a* and 104*b* to the power source driver 107 and installing the cover plate 106, an upper opening and a lower opening of the frame 101 are closed. Of course, the cover plate 106 is acoustically transparent so that vibrations or sounds generated by the diaphragms 103*a* and 103*b* are substantially undistorted by the cover 106.

The power source driver 107 supplies a current to the electromagnets 104*a* and 104*b*. The power source driver 107 also analyzes a waveform of a sound signal output by the push-pull speaker in relation to a frequency of an electric signal supplied to the electromagnets 104*a* and 104*b*. Based on the analysis, the power source driver 107 adjusts a phase difference between a sound signal output by driving the upper diaphragm 103*a* and a sound signal output by driving the lower diaphragm 103*b*. More specifically, by analyzing the waveform of a sound signal in relation to a frequency of the electric signal supplied to the electromagnets 104*a* and 104*b*, the power source driver 107 determines a phase difference between sound signals output by a distance between the upper diaphragm 103*a* and the lower diaphragm 103*b* and supplies an electric signal delayed by the phase difference to the electromagnets 104*a* and 104*b*, thereby adjusting a phase difference between the sound signals. Accordingly, because a time delay does not occur between the upside sound signal and the downside sound signal, an optimized sound source can be reproduced.

Figure 4:
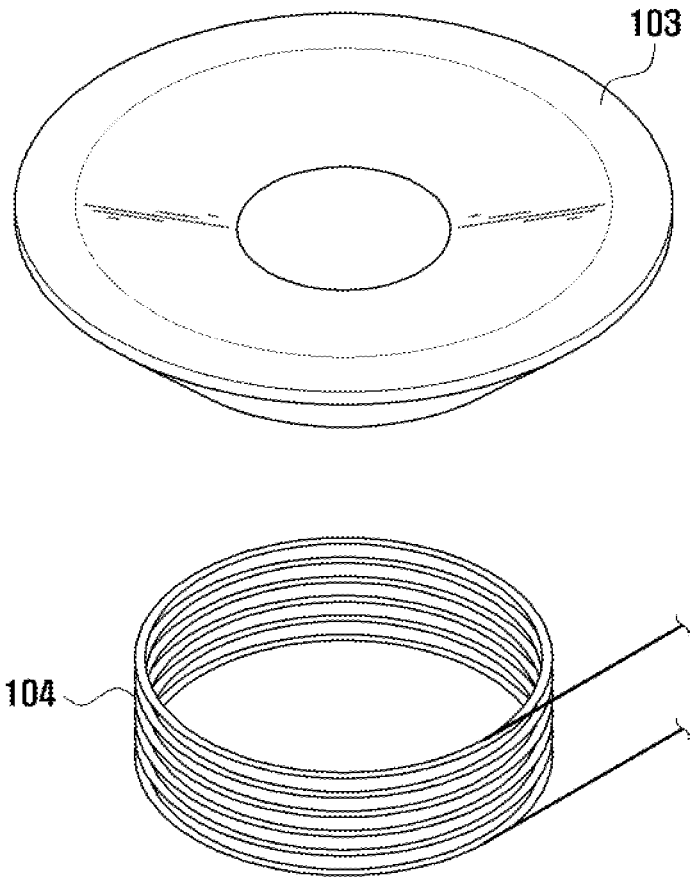
FIG. 4 is a perspective view illustrating a configuration of an electromagnet of a push-pull type speaker device according to an exemplary embodiment of the present invention.

FIG. 4 is a perspective view illustrating a configuration of an electromagnet of a push-pull type speaker device according to an exemplary embodiment of the present invention.

Referring to FIG. 4, an electromagnet 104 is illustrated in relation to a diaphragm 103. When a current is provided to the electromagnet, it produces a magnetic flux that causes movement of the diaphragm 103 thus producing a sound in relation to the provided current. As shown in FIG. 4, the electromagnet 104 is formed separately from diaphragm 103. When implemented in a speaker device, the electromagnet 104 is attached to the diaphragm 103 such that the spacing there between will be minimized. A winding direction of the electromagnet 104 may be formed in either of two directions. In a push-pull type speaker device, the winding direction of the electromagnet will depend on the phase of a current supplied by a power source driver to each of two such electromagnets. More specifically, when a power source driver supplies a current of the same phase to both electromagnets, the electromagnets are formed to have an opposite winding direction. On the other hand, when a current is supplied in a differential pair method, i.e. when a current is supplied in an opposite phase, the electromagnets are formed to have an identical winding direction.

A push-pull type speaker device according to an exemplary embodiment of the present invention is described hereinafter.

In the speaker device according to an exemplary embodiment of the present invention, constituent elements substantially identical or corresponding to those of the speaker device according to the previous exemplary embodiment are denoted by the same reference numerals and therefore a detailed description thereof is omitted. Only dissimilar constituent elements are described here in detail for convenience.

The basic configuration of the push-pull type speaker device according to the present exemplary embodiment is substantially identical to that of the speaker device according to the previous exemplary embodiment. However, the speaker devices are dissimilar in a form of the electromagnets.

Figure 5:
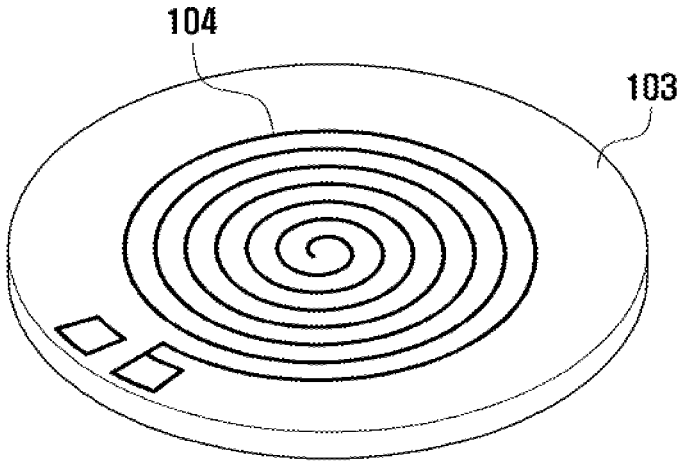
FIG. 5 is a perspective view illustrating a configuration of an electromagnet of a push-pull type speaker according to an exemplary embodiment of the present invention.

FIG. 5 is a perspective view illustrating a configuration of an electromagnet of a push-pull type speaker device according to an exemplary embodiment of the present invention.

Referring to FIG. 5, the electromagnet 104 is printed in an eddy shape on a surface of a diaphragm 103 to be formed integrally with the diaphragm 103. In an exemplary implementation, the diaphragm 103 is made of a polymer resin-based film, and the integral diaphragm 103 and electromagnet 104 are formed by coating adhesives on a surface of the polymer resin-based film, attaching a copper foil thereon, etching a surface of the copper foil to form a coil pattern, and covering the coil pattern with another polymer resin-based film in order to prevent corrosion of the electromagnet 104.

Similar to the previous exemplary embodiment, when the electromagnet 104 printed on the diaphragm 103 is used in a push-pull type speaker device, a winding direction (eddy direction) of an upper electromagnet printed on an upper diaphragm and a winding direction of a lower electromagnet printed on a lower diaphragm are formed such that, when a current flows, the upper electromagnet and the lower electromagnet have an opposite magnetic flux direction.

In accordance with an exemplary embodiment the present invention, the electromagnet 104 is formed integrally with the diaphragm 103, whereby the speaker device can be made smaller than the speaker device in the previous exemplary embodiment in which the electromagnet 104 is wound in a cylindrical shape and attached to the diaphragm 103, thus an electronic device can have a reduced thickness.

In accordance with an exemplary embodiment of the present invention, a coil pattern is printed on the diaphragm 103 in a method of winding in a circular eddy shape or a quadrangular eddy shape from a terminal provided at the outside of the diaphragm 103 to the center of the diaphragm 103, then rewinding in a reverse direction from the center of the diaphragm 103 to another terminal provided at the outside of the diaphragm 103. The diaphragm 103 may be formed by printing the reversed coil patterns in an eddy shape in an upper surface and a lower surface of a polymer resin-based film and electrically connecting the coil patterns on the upper and lower surface. In this case, a coil pattern printed on an upper surface and a lower surface of the polymer resin-based film should be printed in opposite eddy directions. In this way, when the coil patterns of the electromagnet 104 are printed on the upper and lower surface of the diaphragm 103 in opposite eddy directions, a current flowing through both of the coil patterns flows in the same direction, thereby further increasing efficiency per unit size of the diaphragm 103 and enabling a reduced size of the speaker device for the same output.

The speaker device according to an exemplary embodiment of the present invention can be applied to any electronic device that includes a speaker. For example, the speaker device can be used in an information and communication device and multimedia device requiring a decrease in size and thickness and an increase in performance, such as a mobile terminal, mobile phone, wired/wireless phone, Portable Multimedia Player (PMP), Personal Digital Assistant (PDA), smart phone, and applications thereof.

As described above, in accordance with exemplary embodiments of the present invention, by using both a north pole and a south pole of a permanent magnet and adjusting a winding direction of an electromagnet, both a magnetic flux coupled to the north pole and a magnetic flux coupled to the south pole can be converted to a sound signal.

Further, by using both a north pole and a south pole of a permanent magnet, a sound volume increase of about two times can be generated with only a single permanent magnet and thus a speaker device can have a reduced size, a light weight, and high performance.

While the invention has been shown described with reference to certain exemplary embodiments thereof, it will be understood by those skilled in the art that various changes in form and details may be made therein without departing from the spirit and scope of the invention as defined by the appended claims and their equivalents.

What is claimed is:

1. A speaker device comprising:

a frame;

a permanent magnet installed within the frame using a fixing device;

a first diaphragm and a second diaphragm installed in opposite end portions of the frame;

a pair of electromagnets, respectively corresponding to the first and second diaphragm, each installed in a same range from the permanent magnet; and a power source driver for supplying a current to the pair of electromagnets, wherein a winding direction of each electromagnet is formed such that, when current is provided from the power source driver to each of the electromagnets, the pair of electromagnets have an opposite magnetic flux direction, and wherein the fixing device comprises:

a plurality of grooves formed at the periphery of the permanent magnet; and a plurality of protrusions formed within the frame and inserted into the plurality of grooves.

2. The speaker device of claim 1, wherein the winding direction of each electromagnet is in an opposite direction if the power source driver supplies current of the same phase to the pair of electromagnets.

3. The speaker device of claim 1, wherein the winding direction of each electromagnet is in an identical direction if the power source driver supplies current to the pair of electromagnets in a differential pair method.

4. The speaker device of claim 1, wherein the power source driver adjusts a phase difference between a sound signal output by driving the first diaphragm and a sound signal output by driving the second diaphragm.

5. The speaker device of claim 1, wherein each electromagnet is wound in a cylindrical shape to be attached to the diaphragm.

6. The speaker device of claim 1, wherein each electromagnet is printed in an eddy shape in the diaphragm to be formed integrally with the diaphragm.

7. The speaker device of claim 6, wherein the eddy shape comprises one of a circular eddy shape and a quadrangular eddy shape.

8. The speaker device of claim 7, wherein each electromagnet is formed having a first terminal provided at an outside of a corresponding diaphragm, wound to the center of the corresponding diaphragm, and rewound in a reverse direction from the center of the corresponding diaphragm to a second terminal provided at the outside of the corresponding diaphragm.

9. The speaker device of claim 8, wherein the each diaphragm is formed of a polymer resin-based film and the corresponding electromagnet is formed on an upper surface and a lower surface of the polymer resin-based film and electrically connected at a center of the diaphragm.

10. A method of manufacturing a speaker device, the method comprising:

installing a permanent magnet within a frame using a fixing device;

disposing a first diaphragm and a second diaphragm in a same range from the permanent magnet and attaching the first diaphragm and the second diaphragm to opposite end portions of the frame; and installing a pair of electromagnets, respectively corresponding to the first and second diaphragm, for receiving current from a power source driver, wherein the forming of the pair of electromagnets for receiving current from the power source driver comprises forming a winding direction of each electromagnet such that, when current is provided from the power source driver to each of the electromagnets, the pair of electromagnets have an opposite magnetic flux direction, wherein the installing of the permanent magnet within the frame using a fixing device comprises inserting a plurality of protrusions formed within the frame into a plurality of grooves formed at the periphery of the permanent magnet.

11. The method of claim 10, wherein the forming of the pair of electromagnets for receiving current from a power source driver comprises forming the winding direction of each electromagnet is in an opposite direction if the power source driver supplies a current of the same phase.

12. The method of claim 10, wherein the forming of the pair of electromagnets for receiving current from a power source driver comprises forming the winding direction of each electromagnet is in an identical direction if the power source driver supplies a current in a differential pair method.

13. The method of claim 10, further comprising adjusting, by the power source driver, a phase difference between a sound signal output by driving the first diaphragm and a sound signal output by driving the second diaphragm.

14. The method of claim 10, wherein the forming of the pair of electromagnets for receiving current from a power source driver comprises one of winding each of the pair of electromagnets in a cylindrical shape to be attached to the corresponding diaphragm and integrally forming each of the pair of electromagnets with the corresponding diaphragm by printing the electromagnet on the diaphragm in an eddy shape.

15. The method of claim 14, wherein the eddy shape comprises one of a circular eddy shape and a quadrangular eddy shape.

16. The method of claim 15, wherein the forming of the pair of electromagnets comprises, for each electromagnet, forming a first terminal provided at an outside of a corresponding diaphragm, winding the electromagnet to the center of the corresponding diaphragm, and rewinding in a reverse direction from the center of the corresponding diaphragm to a second terminal formed at the outside of the corresponding diaphragm.

17. The method of claim 16, wherein the disposing of the first and the second diaphragm comprises, for each diaphragm, forming a polymer resin-based film, forming the corresponding electromagnet on an upper surface and a lower surface of the polymer resin-based film and electrically connecting the electromagnet at a center of the diaphragm.

18. The method of claim 17, wherein the integrally forming of each of the pair of electromagnets with the corresponding diaphragm comprises:

coating an adhesive on a surface of the polymer resin-based film;

attaching a copper foil on the polymer resin-based film;

etching a surface of the copper foil to form a coil pattern; and covering the coil pattern with another polymer resin-based film.

* * * * *